US011118293B2

(12) United States Patent
Beyer

(10) Patent No.: US 11,118,293 B2
(45) Date of Patent: Sep. 14, 2021

(54) DYE EXHAUSTION AND DRYER APPARATUS

(71) Applicant: Bekir Beyer, Kadikoy (TR)

(72) Inventor: Bekir Beyer, Kadikoy (TR)

( * ) Notice: Subject to any disclaimer, the term of this patent is extended or adjusted under 35 U.S.C. 154(b) by 335 days.

(21) Appl. No.: 16/297,293

(22) Filed: Mar. 8, 2019

(65) Prior Publication Data

US 2020/0283939 A1 Sep. 10, 2020

(51) Int. Cl.

| | |
|---|---|
| ***D06B 1/02*** | (2006.01) |
| ***D06B 15/02*** | (2006.01) |
| ***D06B 15/04*** | (2006.01) |
| ***D06B 15/09*** | (2006.01) |
| ***D06B 19/00*** | (2006.01) |
| ***D06B 23/04*** | (2006.01) |
| ***D06B 23/10*** | (2006.01) |

(52) U.S. Cl.

CPC ..... *D06B 23/10* (2013.01); *D06B 1/02* (2013.01); *D06B 15/02* (2013.01); *D06B 15/04* (2013.01); *D06B 15/09* (2013.01); *D06B 19/0035* (2013.01); *D06B 23/04* (2013.01)

(58) Field of Classification Search

None

See application file for complete search history.

(56) References Cited

U.S. PATENT DOCUMENTS

| | | | | |
|---|---|---|---|---|
| 1,824,885 | A | 9/1931 | Hammond | |
| 3,276,138 | A | 10/1966 | Fritz | |
| 3,467,135 | A | 9/1969 | Muskalla | |
| 3,967,581 | A | 7/1976 | Zirbel | |
| 4,393,671 | A | 7/1983 | Ito | |
| 4,675,510 | A | 6/1987 | Yamaguchi | |
| 4,835,354 | A | 5/1989 | Collins | |
| 4,860,688 | A | 8/1989 | Nazzarro | |
| 5,156,026 | A | 10/1992 | Karetnikov et al. | |
| 5,726,427 | A | 3/1998 | Hwang | |
| 9,777,417 | B2 | 10/2017 | Beyer | |
| 10,208,417 | B2 | 2/2019 | Beyer | |
| 2008/0223352 | A1 | 9/2008 | Ando | |
| 2017/0298570 | A1* | 10/2017 | Beyer | D06B 23/10 |
| 2018/0016725 | A1 | 1/2018 | Beyer | |

FOREIGN PATENT DOCUMENTS

| | | |
|---|---|---|
| CN | 100427864 | 10/2008 |
| WO | WO1987005343 | 9/1987 |
| WO | WO1998049383 | 11/1998 |
| WO | WO2016118495 | 7/2016 |

OTHER PUBLICATIONS

U.S. Appl. No. 16/277,503, filed Feb. 15, 2019, Beyer, Bekir.

Authorized officer Shane Thomas, International Search Report/Written Opinion in PCT/US16/13887 dated Jul. 21, 2016, 24 pages.

* cited by examiner

*Primary Examiner* — Levon J Shahinian

(74) *Attorney, Agent, or Firm* — Fish & Richardson P.C.

(57) ABSTRACT

An apparatus for dye application to textile manufactures, exhaustion of the applied dye, and drying of the textile manufacture. The apparatus, in some implementations, includes a dye applicator that applies dye evenly to a textile manufacture of varying length, one or more steam release conduits for heating the textile manufacture with applied dye to exhaust the dye, and a blower system to dry the textile manufacture after application of the applied dye.

15 Claims, 5 Drawing Sheets

DYE EXHAUSTION AND DRYER APPARATUS

BACKGROUND

This specification relates to dye application to textile manufactures, exhaustion of the applied dye, and drying of the textile manufacture.

During the manufacturing of textile products, such as carpet products, samples of the products are dyed to ensure that the textile product being produced is free of material, chemical or process related problems. Typically, a piece of sampled textile manufacture, referred to as a textile sample or textile manufacture, is dyed and examined before committing to a large amount of production to detect any possible unforeseen problems and ensure the product quality and consistency within the standards. If the dyed sample indicates the textile manufacture being produced is within acceptable specifications, then full production may commence. However, if the dyed sample indicates the textile manufacture being produced is not within acceptable specification, then remedial actions are taken, e.g., yarn problems or colorant deviation are resolved, before going into full production.

Checking a textile manufacture sample for these problems requires dyeing of a full width sample so that the defective, e.g., altered molecular structure or orientation, or contaminated, e.g., chemically different fiber mix, yarn can be traced and replaced from its relative location in the loom. With manufacturers producing textiles on looms 90 inches wide and larger, e.g., looms for upholstery, curtain or carpeting, finding a sample dyeing machine large enough to be able to dye full width sample presents challenges. The process of applying dye to textile manufacture samples, exhaustion of the applied dye, and drying of the textile manufacture is expensive and prone to error.

For example, dyeing and drying may take from 8 to 48 hours depending on the dye house work load and the communication between the departments. Such a process entails weaving a full width of a 15-20 linear feet long sample and sending it to the dye house to be dyed. The sample piece cannot be inspected until it finishes going through the entire dyeing and drying cycle with the batch it is dyed together. This results in production machinery sitting idle during the entire time the sample piece is being handled.

Another check process involves the immersion of a full width piece of the textile manufacture in a large container filled with hot water and colorant. This process is less effective than the prior process, as it typically only reveals problems for a chemically different fiber or yarn mixed in another type of fabric either during spinning or weaving processes. This process may not reveal the defective or contaminated yarn because it only "ring" dyes the fiber surface, i.e., the dye only cosmetically stains the outside of the fiber without fully penetrating the fabric, thus appearing to be consistent with the rest of the batch when, in fact, it is not. The fibers needs to be either boiled in a dye bath or steamed after the dye solution is applied on it for a considerable amount of time for any difference in its dye absorbency to be detected. Subsequently, hidden defects appear when fabric goes through proper production procedure resulting in a considerable amount of "factory seconds" that cannot be sold at full market value.

SUMMARY

In general, one innovative aspect of the subject matter described in this specification can be embodied in an apparatus, comprising a cylindrical receiving member that defines a central axis and an outer radius surface upon which a textile manufacture may be rotationally received relative to the central axis; a plurality of clamps disposed within the surface of the cylindrical receiving member and that are operative to clamp at least a first end of the textile manufacture to the cylindrical receiving member and at least a second end of the textile manufacture to the cylindrical receiving member, wherein the clamps each define a transvers axis along which the textile member is received and clamped, and the plurality of claims are spaced apart such that textile manufactures of varying lengths may be clamped to the cylindrical receiving member; a housing in which the cylindrical receiving member is disposed and operative to be in one of an open position in which the cylindrical receiving member is exposed to receive the textile manufacture, and a closed position in which the housing defines a substantially enclosed cavity in which the cylindrical receiving member is enclosed; a steam outlet fluidly coupled to the housing and that, when further coupled to a steam supply and when the housing is in the closed position, releases steam into the housing, wherein the steam enters the substantially enclosed cavity by the fluid coupling; and a drive motor coupled to the cylinder receiving member that, when actuated, causes the cylindrical receiving member to rotate about its central axis such so that when a textile manufacture is received on the outer radius surface of the cylinder receiving member, the textile manufacture rotates over the steam outlet.

Particular embodiments of the subject matter described in this specification can be implemented so as to realize one or more of the following advantages. The dye exhaustion and dryer apparatus results in the uniform application of dye across an entire production sample of textile manufacture, thus reducing or eliminating inconsistent application of dye due to human error. The controlled application of steam followed by a drying cycle greatly reduces sample processing time over the manual application of dye and dye exhaustion and drying. This, in turn, increases precision and application uniformity, and reduces overall dyed sample deliver time.

Furthermore, by processing textile strips up to the production width of the textile mill, wasteful, costly and time-consuming check rolls that hold up the fabric forming process are eliminated.

Additionally, because the cylindrical receiving member has multiple clamps that are spaced apart, textile samples of varying lengths can be tested, and even two different textile samples can be tested at the same time.

Other advantageous uses of the apparatus include continuous range initial color checking, custom color matching, and new color line development. Furthermore, the apparatus facilitates testing such as qualitative colorant, auxiliary chemicals and topical treatment testing, low-melt fiber performance testing, multi-fiber-tone creel proofing, and latex and tile polymer curing testing.

The details of one or more embodiments of the subject matter described in this specification are set forth in the accompanying drawings and the description below. Other features, aspects, and advantages of the subject matter will become apparent from the description, the drawings, and the claims.

Figure 1:
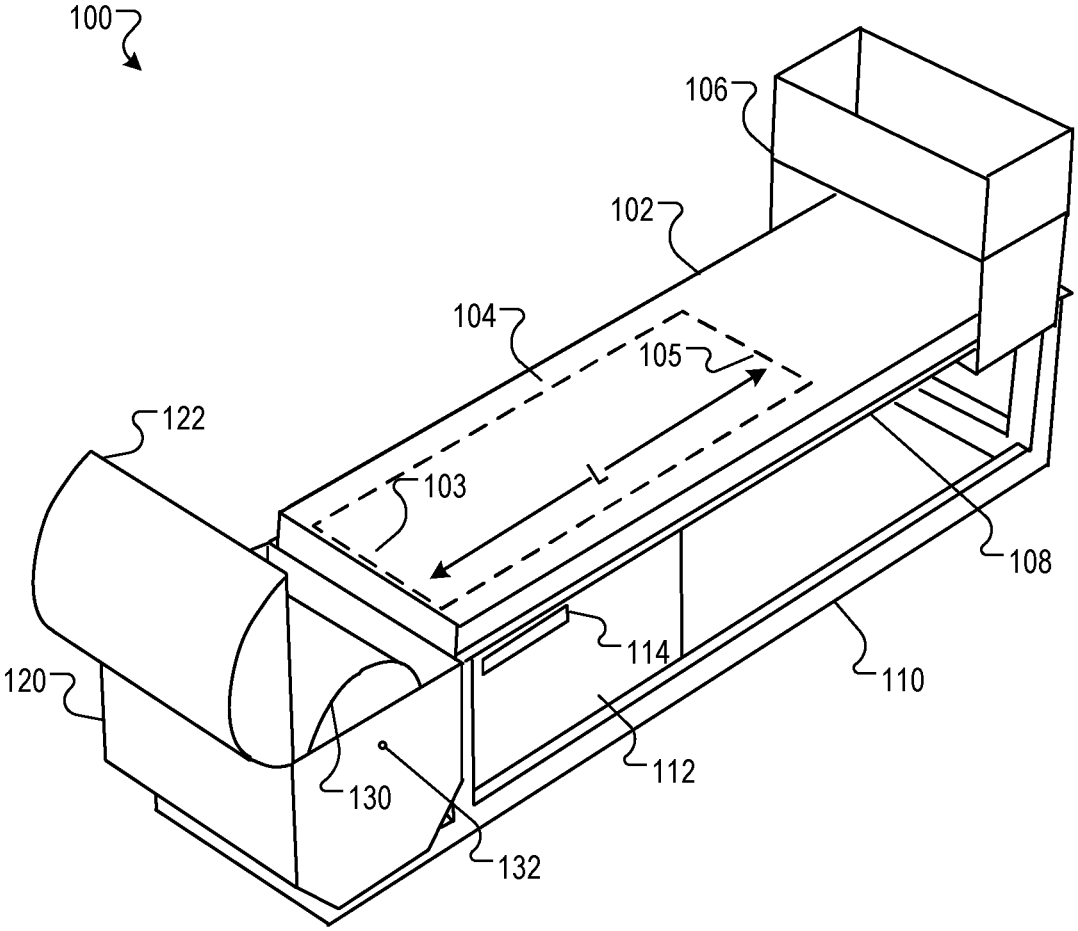
FIG. 1 is an isometric view of a first implementation of the dyeing apparatus.

Like reference numbers and designations in the various drawings indicate like elements. To avoid congestion in the drawings and for brevity of description, reference numbers may not be repeated in subsequent drawings and descriptions of elements previously described may be omitted in subsequent drawings.

DETAILED DESCRIPTION

FIG. 1 is a side view of a dyeing and drying apparatus 100. In FIG. 1, the apparatus 100 is in an open position. The apparatus 100 includes a platform 102 defining a substantially flat top surface upon which a textile sample 104 may be received. The sample 104 has a first end 103 and a second end 105, and the length L of the sample is such that it may be received without overlap on a cylindrical member 130, which will be described in more detail below.

When the sample is placed on the top surface 102, a dye applicator carriage 106, which includes a dye applicator, deposits dye onto the sample 104. To apply dye to the sample 104, a dye applicator carriage 106 is movably disposed along a longitudinal axis relative to the platform 102 and is configured to deposit dye on sample 104 received on the platform 102 as the dye applicator carriage 106 traverses the longitudinal axis of the apparatus 100. For example, the carriage 106 may include rollers in engagement with a track 108 on either side of the platform 102, and may traverse the platform 102 by means of an electro-mechanical driver. The driver may be a belt drive, or a screw drive, or any other appropriate driver mechanism. One example carriage is disclosed in U.S. Pat. No. 9,777,417, entitled "Fluid Regulating Apparatus," the disclosure of which is incorporated herein by reference.

Once dye has been applied to the textile sample 104, the applicator carriage is returned to the end opposite the cylindrical receive member 130. The textile sample 104 is then attached to the cylindrical receiving member 130. The cylindrical receiving member rotates about an axel 132 located within a housing 120. The housing 120 includes a lid 122 that may be closed after the textile 104 is attached to the cylindrical receive member 130, and the dye is then exhausted by a steaming process that will be described in more detail below.

Figure 2:
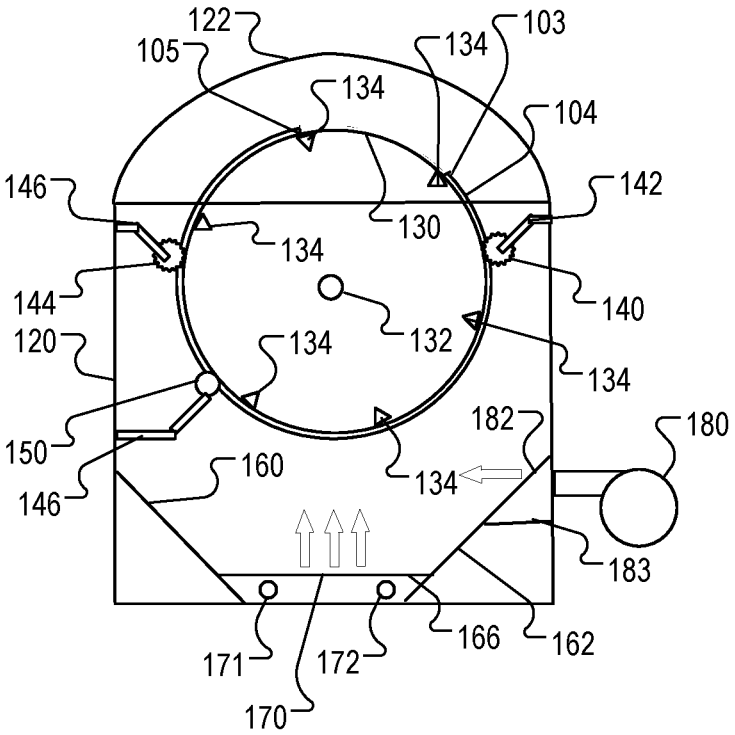
FIG. 2 is a side view of a base steam box of the dyeing apparatus.
Figure 3:
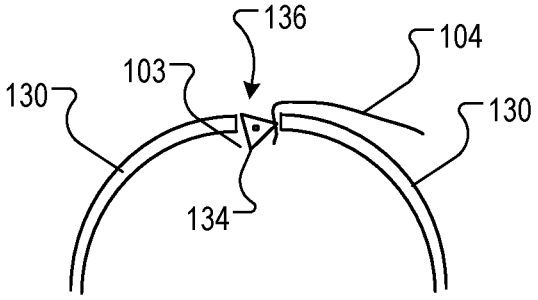
FIG. 3 is a side view of a clamping device in a cylindrical receiving member used in FIG. 1.

FIG. 2 is a side view of a steam box that is formed by the housing 120 and lid 122 when the lid is in the closed position. In this implementation, the textile sample 104 is secured to the cylindrical receive member 130 (in this implementation, a drum) by tri-lobal rods 134 that each respectively rotate within a slot 136 (shown in FIG. 3) spaced apart on the receiving member 130. More specifically, and as illustrated in FIG. 3, the tri-lobal rods rotate within respective slots in the outer radius surface of the cylindrical receiving member 130 to clamp the textile sample 104 to the surface of the receiving member 130. As shown in FIG. 2, the receiving member 130 includes a plurality of rods 134 that are spaced apart so that textile samples of varying lengths L may be clamped to the receiving member 130. Multiple rods 134 are disposed within the slots on the surface of the cylindrical receiving member 130 to form multiple clamps. As shown in FIG. 2, the clamps have clamped the first end 103 of the textile sample 104 to the cylindrical receiving member 130 and second end 105 of the textile sample 104 to the cylindrical receiving member 130. The clamps each define a transvers axis along which the textile sample 104 is received and clamped, as shown in FIG. 3.

In additional to the clamping a single textile sample 104 to the member 130, multiple textile samples can be clamped to the receiving member 130. For example, two different textile samples could be clamped in a non-overlapping manner using four different clamps, or even by using the same two clamps, provided each end of each sample is clamped on different corners of a same tri-lobal rod 134 in a slot 136.

The housing 120 in which the cylindrical receiving member is disposed is operative to be in one of an open position in which the cylindrical receiving member 130 is exposed to receive the textile sample 104, and a closed position in which the housing 120 defines a substantially enclosed cavity in which the cylindrical receiving member 130 is enclosed.

A steam outlet 170 is fluidly coupled to the housing 120. When further coupled to a steam supply and when the housing 120 is in the closed position, the steam outlet 170 releases steam into the housing 120 by fluid coupling. Steam may be provided by perforated steam pipes 171 and 172 that provide steam from a steam supply.

A drive motor (not shown) is coupled to the cylinder receiving member 130. When actuated, the drive motor causes the cylindrical receiving member 130 to rotate about its central axis such so that when a textile sample 104 is received on the outer radius surface of the cylinder receiving member 130, the textile manufacture rotates over the steam outlet 170. The heat exhausts the dye that has been applied to the sample textile sample 104.

Buffer plates 160 and 162 reduce the overall volume of the cavity formed within the housing. One buffer plate, plate 162, also has an outlet 182 that is coupled to a blower device 180 by a supply plenum 183. The blower device 108 blows air into the substantially enclosed cavity when energized to assist in drying the textile sample 104 after the dye has been exhausted.

The dyeing and drying apparatus 100 also includes control subsystem, indicated by control panel 114, that is electrically coupled to the blower device and a steam supply control. During a first time period, the control subsystem causes the steam supply to provide steam and the blower device 180 to be de-energized. It is during this time the dye is exhausted by the steam heat. During a second time period after the first time period, the control system causes the steam supply to not provide steam and the blower device 180 to be energized. Thus, hot air is circulated through the cavity, and exits through an outlet, to dry the sample 104. After drying, the first housing 120 may be opened and the sample 104 removed for inspection.

The control system may be used to manually turn on and turn off the steam supply and the blower device 180. Additionally, the control system can be programmed such that during a first time period, the steam supply provides steam and the blower device is de-energized and that, during a second time period after the first time period, the steam supply does not provide steam and the blower device is energized. The first and second time periods may also be programmed, and may depend on the dye used and the type of textile sample used.

In some implementations, the dyeing and drying apparatus 100 includes at least one pressure roller 144 attached to the housing 120 by a biasing member 146 that biases the pressure roller 144 against the textile sample 104 received by the cylindrical receiving member 130 and that rolls along the surface of the textile sample 104 as the cylindrical receiving member rotates 130 about its central axis. Any appropriate biasing member 146, such as a spring tensioned arm, may be used. The pressure roller helps apply dye evenly across the textile sample 104.

A vacuum device 150 attached to the housing by a biasing member 146 that biases the vacuum device against the textile sample 104 received by the cylindrical receiving member 130 and that traverses the surface of the textile manufacture as the cylindrical receiving member 130 rotates about its central axis. The vacuum device 150 can be activated after the exhaustion is complete to assist in drying the textile sample 104. In some implementations, the vacuum device 150 is moved into position only when the blower is activated; at other times, is positioned such that it is not in contact with the textile sample 104. The movement can be controlled by the control system.

Figure 4:
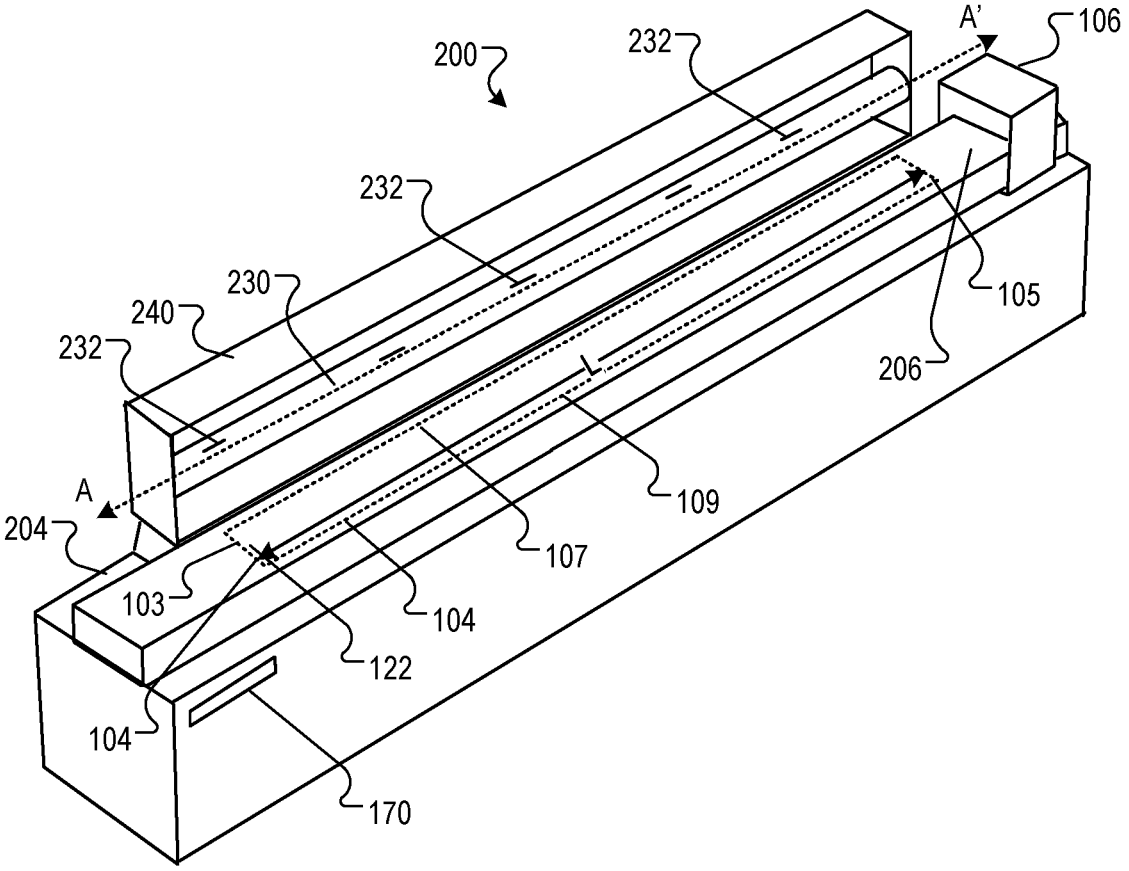
FIG. 4 is an isometric view of a second implementation of the dyeing apparatus.

FIG. 4 is an isometric view of a second implementation of dyeing apparatus 200. This implementation differs from the implementation of FIG. 1 in that the cylindrical receiving member 230 is disposed within a lid 240, that along with a base portion 206 forms a first housing. A base 204 supports the lid 240 forming a housing The lid 240 is in movable disposition relative to the platform 206 by means of a hinge or some other attachments that allow movement of the lid 240. When the lid is moved into a closed position, a substantially enclosed cavity is formed in which the flat top surface of the platform 206 defines a bottom surface of the substantially enclosed cavity. The lid portion 240 defines a longitudinal axis AA' and the cylindrical receiving member 230 is rotatably mounted within the lid portion 240 such that the rotational axis of the cylindrical receiving member 230 is parallel to the longitudinal axis AA' of the lid portion 240. A drive motor (not shown) connected to a control system causes the member 230 to rotate.

The dye applicator carriage 106 operates in the same manner as described with reference to FIG. 1. Once dye is applied to the textile sample 104, the textile sample is wrapped around the cylindrical receiving member 230 continuously, and typically in a manner in which the sides of the textile abut each other, as shown with reference to FIG. 5, which is an isometric view of the cylindrical receiving 230 member of FIG. 4 with a textile sample 104 held in place by clamping devices 232. A corner of the textile sample 104, defined by sides 103 and 107, is inserted into a clamp 232 and clamped into place. The cylindrical receiving member 230 is then rotated, and the textile sample 104 is wrapped around the member. A second corner, defined by sides 105 and 109, is then inserted into another clamp 232 to secure the textile sample 104. Multiple clamp devices 232 are positioned at positions on the longitudinal axis of the cylindrical receiving member 230 to receive the ends of the textile sample 104 that are of various lengths. Moreover, by use of multiple clamps 232, two or more textile samples can be processed by the apparatus 200.

Figure 5:
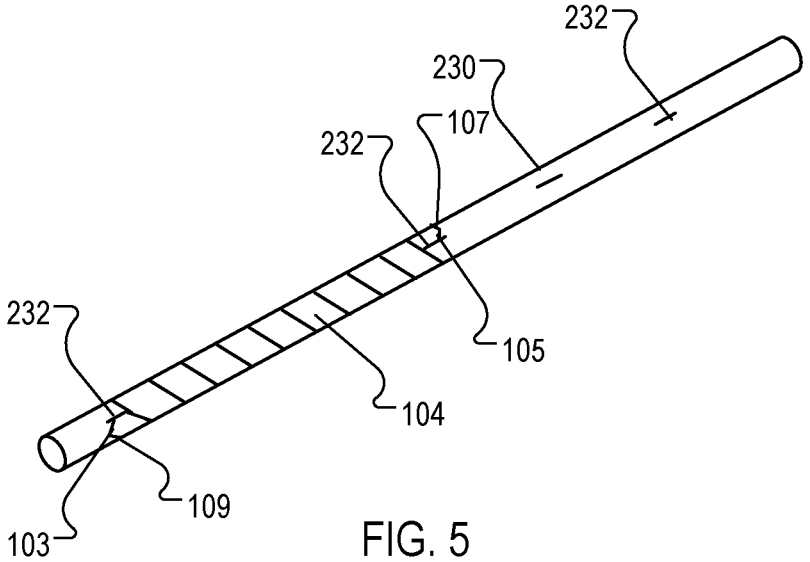
FIG. 5 is an isometric view of the cylindrical receiving member of FIG. 4 with a textile sample held in place by clamping devices.
Figure 6:
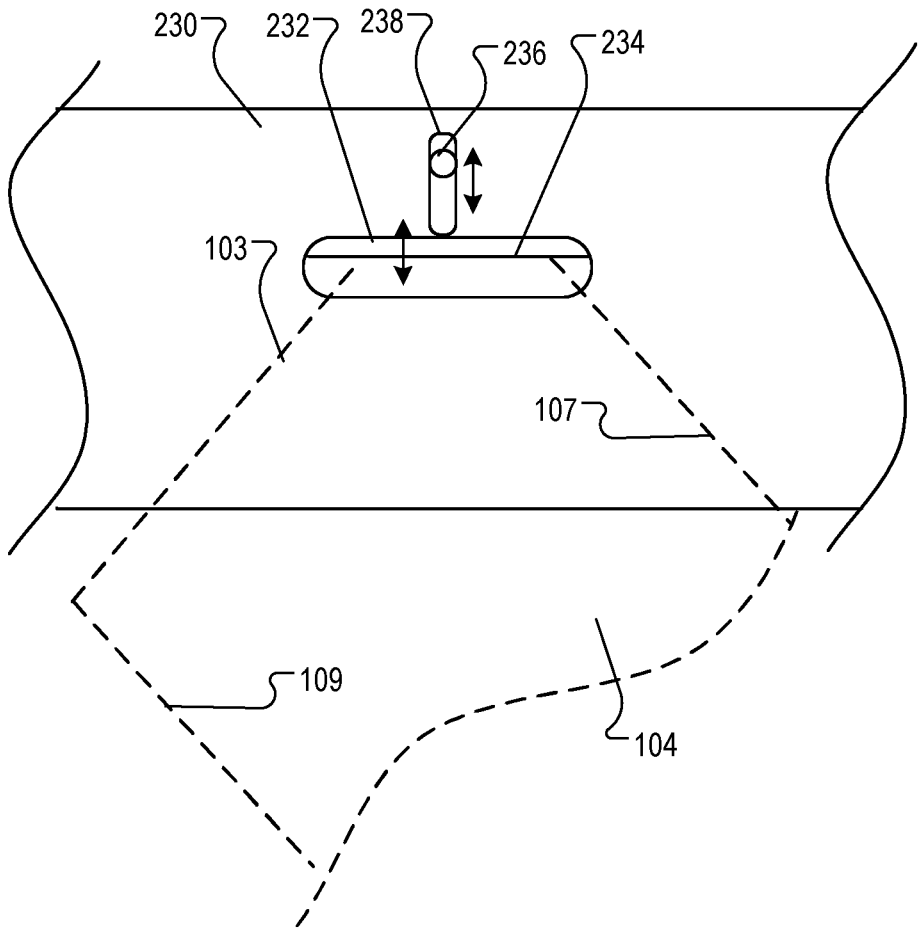
FIG. 6 is an illustration of a clamping device in the cylindrical receiving member of FIG. 5

FIG. 6 is an illustration of a clamping device 232 in the cylindrical receiving member 230 of FIG. 5. The clamping devices 232 are formed by respective sliding sleeves 234 beneath respective slots in the outer radius surface of the cylindrical receiving member 230 to form the clamp 232. An actuator 236 is connected to the sleeve 234 and may be moved up and down along a slot 238 that is perpendicular to the slot of clamp 232, thereby moving the sleeve 234 to clamp and unclamp the textile sample 104. The actuator 236 may be a spring loaded button, a screw mechanism, or any other device that can be actuated to lock and unlock the sleeve 234 as adjusted by the position of the actuator 236 in the slot 238, as indicted by the double-headed arrows. As shown in FIG. 6, a corner of the textile sample 104, defined by sides 103 and 107, is being clamped into the clamp 232.

Figure 7:
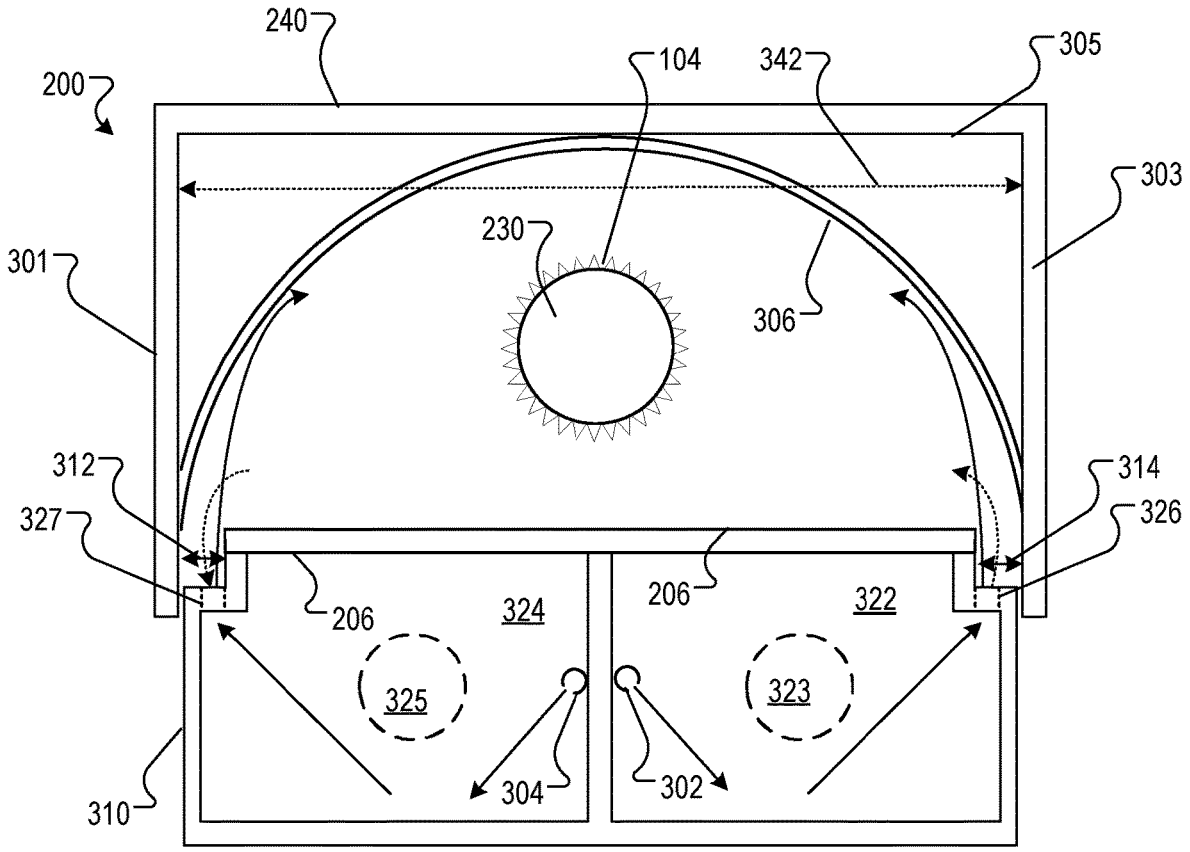
FIG. 7 is a cross-section illustration of the second implementation of the dyeing apparatus of FIG. 5.

FIG. 7 is a cross-section illustration of the second implementation of the dyeing apparatus 200 of FIG. 5. The cavity is defined by side walls 301 and 203, and ceiling 205. Between the side walls 201 and 203 and the surface 206 are respective gaps. A supply plenum 322 includes a supply hole 323 that is connected to the blower system. A return plenum 324 includes an exit hole 325 through which air is exhausted after traversing from the supply plenum 322, through the cavity and into the return plenum 324, as indicated in FIG. 7 That is, when the first lid 240 is closed, the plenums 322 and 324 are fluidly coupled to the substantially enclosed cavity, and the blower system is fluidly coupled to the first plenum 322 so that air is communicated into the substantially enclosed cavity through the supply plenum 322 and communicated from the substantially enclosed cavity through the return plenum 324. The blower system may optionally include heating elements so that the air blown into the supply plenum 322 is heated.

A first side 301 and a second side 303 define a first width 342 such that the sides 301 and 303 close over the side walls of the platform. The substantially flat top surface 206 is of a second width that is less than the first width and positioned such that a first gap 312 exists between the first side of the platform and a first side of the substantially flat top surface and a second gap 314 exists between the second side of the platform and the second side of the substantially flat top surface. Within the gap 312 an egress 326 of the supply plenum 322 is located, and with the gap 314 an ingress 327 of the return plenum 324 is located. The ingress 326 and egress 327 may run substantially the length of the enclosed cavity so that air may flow evenly through the cavity during the drying process. The ingress 326 and egress 327 allow for entry of steam, described below, but when the blower device is operations, allow for ingress of air into the cavity by the ingress 326 and egress of air from the cavity by the egress 327, as indicated by the dashed directional arrows.

Within the plenums 322 and 324 are steam release conduits 302 and 304 that, when coupled to steam supply (not shown), release steam into the plenums. In some implementations, the steam is released in a downward direction to facilitate venting into the substantially enclosed cavity through the ingress 326 and egress 327. Thus the steam enters the substantially enclosed cavity by fluid coupling, as indicated by the solid direction arrows. The steam heats up the sample 104, and thus the applied dye solution in the sample, and exhausts the dye applied to the sample.

After the dye is exhausted, a control system 170, which is electrically coupled to the blower device and a steam supply control system (e.g., valves that control the steam venting into the conduits 302 and 304), causes the steam supply to not provide steam to the steam release conduits, and energizes a blower device connected to the plenum 322. The blower device is in fluid communication with the enclosed cavity by the supply plenum 322, and hot air is circulated through the cavity, and exits out of the return plenum 324, to dry the sample 102. After drying, the lid may be opened and the sample 104 removed for inspection.

The lid 240 may, in some implementations, include sheeting or some other surface that defines an interior housing surface having a geometry that facilitates steam condensation to run downward along the interior housing surface to a side of the enclosed cavity. This reduces or eliminates dripping of water droplets onto the sample 104. The dripping of water droplets can affect the dye exhausting and uniformity of color. As shown in FIG. 7, the geometry may be curved to define a curved surface 306. Other geometries may also be used.

Although now shown, rollers and a vacuum device may be attached to the lid 204 and biased against the sample 104.

Control features of subject matter and the operations described in this specification can be implemented in digital electronic circuitry, or in computer software, firmware, or hardware, including the structures disclosed in this specification and their structural equivalents, or in combinations of one or more of them.

The operations described in this specification can be implemented as operations performed by a data processing apparatus on data stored on one or more computer-readable storage devices or received from other sources. The term "data processing apparatus" encompasses all kinds of apparatus, devices, and machines for processing data, including by way of example a programmable processor, a computer, a system on a chip, or multiple ones, or combinations, of the foregoing. The apparatus can include special purpose logic circuitry, e.g., an FPGA (field programmable gate array) or an ASIC (application-specific integrated circuit).

While this specification contains many specific implementation details, these should not be construed as limitations on the scope of any features or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the subject matter have been described. Other embodiments are within the scope of the following claims.

What is claimed is:

1. An apparatus, comprising:

a cylindrical receiving member that defines a central axis and an outer radius surface upon which a textile manufacture may be rotationally received relative to the central axis;

a plurality of clamps disposed within the surface of the cylindrical receiving member and that are operative to clamp at least a first end of the textile manufacture to the cylindrical receiving member and at least a second end of the textile manufacture to the cylindrical receiving member, wherein the clamps each define a transvers axis along which the textile member is received and clamped, and the plurality of claims are spaced apart such that textile manufactures of varying lengths may be clamped to the cylindrical receiving member;

a housing in which the cylindrical receiving member is disposed and operative to be in one of an open position in which the cylindrical receiving member is exposed to receive the textile manufacture, and a closed position in which the housing defines a substantially enclosed cavity in which the cylindrical receiving member is enclosed;

a steam outlet fluidly coupled to the housing and that, when further coupled to a steam supply and when the housing is in the closed position, releases steam into the housing, wherein the steam enters the substantially enclosed cavity by the fluid coupling; and a drive motor coupled to the cylinder receiving member that, when actuated, causes the cylindrical receiving member to rotate about its central axis such so that when a textile manufacture is received on the outer radius surface of the cylinder receiving member, the textile manufacture rotates over the steam outlet.

2. The apparatus of claim 1, further comprising:

a blower device coupled to the housing and that, when the housing is in the closed position, is fluidly coupled to the substantially enclosed cavity and blows air into the substantially enclosed cavity when the blower device is energized.

3. The apparatus of claim 2, wherein the blower device is coupled to the housing through a supply plenum.

4. The apparatus of claim 2, wherein the blower device is coupled to the housing separate from the supply plenum.

5. The apparatus of claim 2, further comprising a control subsystem electrically coupled to the blower device and a steam supply control system and that, during a first time period, causes the steam supply to provide steam to the steam release conduit and the blower device to be de-energized and that, during a second time period after the first time period, causes the steam supply to not provide steam to the steam release conduit and the blower device to be energized.

6. The apparatus of claim 1, further comprising at least one pressure roller attached to the housing by a biasing member that biases the pressure roller against the textile manufacture received by the cylindrical receiving member and that rolls along the surface of the textile manufacture as the cylindrical receiving member rotates about its central axis.

7. The apparatus of claim 1, further comprising at least one vacuum device attached to the housing by a biasing member that biases the vacuum device against the textile manufacture received by the cylindrical receiving member and that traverses the surface of the textile manufacture as the cylindrical receiving member rotates about its central axis.

8. The apparatus of claim 1, wherein the housing comprises:

a base portion;

a lid portion that is movably connected to the base portion and moves from a first position in the open position to a second position in the closed position; and wherein the lid portion defines a longitudinal axis and the cylindrical receiving member is rotatably mounted within the lid portion such that the rotational axis of the cylindrical receiving member is parallel to the longitudinal axis of the lid portion.

9. The apparatus of claim 8, wherein:

the base portion includes a platform that defines a longitudinal axis, and further comprising:

a dye applicator carriage that is movably disposed along the longitudinal axis of the platform relative to the platform and is configured to deposit dye on a textile manufacture received on the platform as the dye applicator carriage traverses the longitudinal axis.

10. The apparatus of claim 8, wherein:

a first clamp is position at a first position on the longitudinal axis of the cylindrical receiving member and receives the first end of the textile manufacture; and a second clamp is position at a second position on the longitudinal axis of the cylindrical receiving member and spaced apart from the first clamp and receives a second end of the textile manufacture.

11. The apparatus of claim 10, wherein the first and second clamps are formed by respective sliding sleeves beneath respective slots in the outer radius surface of the cylindrical receiving member.

12. The apparatus of claim 1, wherein the housing comprises:

a base portion;

a lid portion that is movably connected to the base portion and moves from a first position in the open position to a second position in the closed position; and the cylindrical receiving member is rotatable mounted within the base portion.

13. The apparatus of claim 12, wherein:

the base portion includes a platform that defines a longitudinal axis, and further comprising:

a dye applicator carriage that is movably disposed along the longitudinal axis of the platform relative to the platform and is configured to deposit dye on a textile manufacture received on the platform as the dye applicator carriage traverses the longitudinal axis.

14. The apparatus of claim 12, wherein:

a first clamp is positioned at an angle from a second clamp on the cylindrical receiving member such that the first clamp receives the first end of the textile manufacture and the second clamp receives the second end of the textile manufacture.

15. The apparatus of claim 12, wherein the first and second clamps are formed by respective rotating tri-lobal rod that rotates within respective slots in the outer radius surface of the cylindrical receiving member.

* * * * *